US008789716B2

(12) United States Patent
Larson et al.

(10) Patent No.: US 8,789,716 B2
(45) Date of Patent: Jul. 29, 2014

(54) MULTI-CHAMBER CONTAINER SYSTEM FOR STORING AND MIXING LIQUIDS

(75) Inventors: Brian G. Larson, Orem, UT (US); Daryl J. Tichy, Orem, UT (US)

(73) Assignee: Solutions Biomed, LLC, Orem, UT (US)

( * ) Notice: Subject to any disclaimer, the term of this patent is extended or adjusted under 35 U.S.C. 154(b) by 906 days.

(21) Appl. No.: 12/617,557

(22) Filed: Nov. 12, 2009

(65) Prior Publication Data

US 2010/0116346 A1 May 13, 2010

Related U.S. Application Data

(60) Provisional application No. 61/113,974, filed on Nov. 12, 2008.

(51) Int. Cl.
*B65D 21/02* (2006.01)

(52) U.S. Cl.
USPC ..... 220/23.86; 215/6; 215/10; 206/514

(58) Field of Classification Search
CPC ..... B65D 21/0233; B65D 21/0234; B65D 11/04; B65D 23/04; B65D 25/20
USPC ..... 220/23.83, 23.86, 23.88, 23.6, 521; 206/219, 216, 514; 215/6, 10
See application file for complete search history.

(56) References Cited

U.S. PATENT DOCUMENTS

| | | | |
|---|---|---|---|
| 716,077 | A | 12/1902 | Morrin |
| 734,467 | A | 7/1903 | Martien |
| 2,103,999 | A | 12/1937 | Muller et al. |

(Continued)

FOREIGN PATENT DOCUMENTS

| | | |
|---|---|---|
| GB | 2189394 | 10/1987 |
| WO | WO 03/080231 | 10/2003 |

(Continued)

OTHER PUBLICATIONS

SeaquistPerfect Dispensing Bag on Valve; http://www.seaquistperfect.com/PAGES/EP/VOV.html ; as accessed on Mar. 3, 2008; 2 pages.

(Continued)

*Primary Examiner* — Stephen Castellano
(74) *Attorney, Agent, or Firm* — Thorpe North & Western LLP

(57) ABSTRACT

The present disclosure is drawn to a multi-component container system and related methods for storing and mixing liquids and associated methods of use. The system includes a first chamber configured to hold a first liquid and which has at least one opening and a second chamber and a second chamber configured to hold a second liquid and having at least one opening. The at least one opening on the second chamber is capable of being operably connected to the at least one opening of the first chamber and the second chamber can be smaller relative to the first chamber. The system can have two configurations, a first configuration and a second configuration. In the first configuration the second chamber can be removably disposed within the first chamber. In the second configuration the second chamber can be external to the first chamber and the at least one opening of the second chamber is operably connected with the at least one opening of the first chamber such that the second liquid is allowed to contact the first liquid.

20 Claims, 5 Drawing Sheets

(56) References Cited

U.S. PATENT DOCUMENTS

| | | | | |
|---|---|---|---|---|
| 2,304,104 | A | | 12/1938 | Klabunde et al. |
| 3,172,568 | A | | 3/1965 | Modderno |
| 3,255,924 | A | | 6/1966 | Modderno |
| 3,608,782 | A | | 9/1971 | Salhicq |
| 4,021,338 | A | | 5/1977 | Harkin |
| 4,130,198 | A | * | 12/1978 | Aho ..... 206/221 |
| 4,297,298 | A | | 10/1981 | Crommelynch et al. |
| 4,311,598 | A | | 1/1982 | Verachtert |
| 4,315,570 | A | | 2/1982 | Silver et al. |
| 4,321,255 | A | | 3/1982 | Boden |
| 4,371,094 | A | | 2/1983 | Hutter, III |
| 4,414,127 | A | | 11/1983 | Fu |
| 4,509,641 | A | | 4/1985 | Scieri et al. |
| 4,618,444 | A | * | 10/1986 | Hudson et al. ..... 8/111 |
| 4,655,975 | A | | 4/1987 | Snoble |
| 4,750,615 | A | | 6/1988 | Kaufeler |
| 4,779,763 | A | | 10/1988 | Klawitter |
| 4,808,006 | A | | 2/1989 | Kaufeler |
| 4,826,658 | A | | 5/1989 | Kay |
| 4,832,968 | A | | 5/1989 | Forage et al. |
| 4,915,955 | A | | 4/1990 | Gormori |
| 5,152,965 | A | * | 10/1992 | Fisk et al. ..... 422/547 |
| 5,291,991 | A | | 3/1994 | Meyer |
| 5,349,083 | A | | 9/1994 | Brougham et al. |
| 5,357,636 | A | | 10/1994 | Dresdner et al. |
| 5,368,867 | A | | 11/1994 | Da Silva et al. |
| 5,405,051 | A | | 4/1995 | Miskell |
| 5,409,141 | A | * | 4/1995 | Kikuchi et al. ..... 222/81 |
| 5,419,908 | A | | 5/1995 | Richter et al. |
| 5,437,858 | A | | 8/1995 | Hungerbach et al. |
| 5,494,644 | A | | 2/1996 | Thomas et al. |
| 5,508,046 | A | | 4/1996 | Cosentino et al. |
| 5,563,132 | A | | 10/1996 | Bodaness |
| 5,638,992 | A | | 6/1997 | Lim et al. |
| 5,709,870 | A | | 1/1998 | Yoshimura et al. |
| 5,730,326 | A | | 3/1998 | Kaeser |
| 5,813,557 | A | * | 9/1998 | Oratz ..... 220/23.9 |
| 5,824,267 | A | | 10/1998 | Kawasumi et al. |
| 5,875,889 | A | | 3/1999 | Albisetti |
| 5,945,032 | A | | 8/1999 | Breitenbach et al. |
| 5,951,993 | A | | 9/1999 | Scholz et al. |
| 5,977,403 | A | | 11/1999 | Byers |
| 5,997,585 | A | | 12/1999 | Scialla et al. |
| 6,021,892 | A | | 2/2000 | Baudin |
| 6,027,469 | A | | 2/2000 | Johnson |
| 6,073,803 | A | | 6/2000 | Sturm et al. |
| 6,085,945 | A | | 7/2000 | Fransen |
| 6,114,298 | A | | 9/2000 | Petri et al. |
| 6,197,814 | B1 | | 3/2001 | Arata |
| 6,200,946 | B1 | | 3/2001 | Blum et al. |
| 6,218,351 | B1 | | 4/2001 | Busch et al. |
| 6,231,848 | B1 | | 5/2001 | Breitenbach et al. |
| 6,242,009 | B1 | | 6/2001 | Batarseh et al. |
| 6,257,253 | B1 | | 7/2001 | Lentsch et al. |
| 6,277,414 | B1 | | 8/2001 | Elhaik et al. |
| 6,293,433 | B1 | | 9/2001 | Joulia |
| 6,302,968 | B1 | | 10/2001 | Baum et al. |
| 6,368,611 | B1 | | 4/2002 | Whitbourne et al. |
| 6,379,712 | B1 | | 4/2002 | Yan et al. |
| 6,436,342 | B1 | | 8/2002 | Petri et al. |
| 6,524,624 | B1 | | 2/2003 | Morelli et al. |
| 6,540,791 | B1 | | 4/2003 | Dias |
| 6,569,353 | B1 | | 5/2003 | Giletto et al. |
| 6,583,176 | B2 | | 6/2003 | Arata et al. |
| 6,630,172 | B2 | | 10/2003 | Batarseh |
| 6,660,289 | B1 | | 12/2003 | Wilmotte et al. |
| 6,743,348 | B2 | | 6/2004 | Holladay et al. |
| 6,797,302 | B1 | | 9/2004 | Ben Yehuda et al. |
| 6,827,766 | B2 | | 12/2004 | Carnes et al. |
| 6,851,580 | B2 | | 2/2005 | Stank et al. |
| 6,866,145 | B2 | | 3/2005 | Richards et al. |
| 6,939,564 | B2 | | 9/2005 | Ranger et al. |
| 6,939,566 | B2 | | 9/2005 | Batarseh et al. |
| 6,959,807 | B2 | | 11/2005 | Sharon et al. |
| 6,962,714 | B2 | | 11/2005 | Hei et al. |
| 7,033,511 | B2 | | 4/2006 | Zawada et al. |
| 7,083,043 | B2 | | 8/2006 | Sharon |
| 7,124,788 | B2 | | 10/2006 | Pericard |
| 7,131,784 | B2 | | 11/2006 | Lee et al. |
| 7,287,670 | B2 | | 10/2007 | Yoshida et al. |
| 7,351,684 | B2 | | 4/2008 | Tichy et al. |
| 7,462,590 | B2 | | 12/2008 | Tichy et al. |
| 7,473,675 | B2 | | 1/2009 | Tichy et al. |
| 7,504,369 | B2 | | 3/2009 | Tichy et al. |
| 7,507,701 | B2 | | 3/2009 | Tichy et al. |
| 7,511,007 | B2 | | 3/2009 | Tichy et al. |
| 7,534,756 | B2 | | 5/2009 | Tichy et al. |
| 7,553,805 | B2 | | 6/2009 | Tichy et al. |
| 2002/0108968 | A1 | | 8/2002 | Dumont |
| 2002/0137648 | A1 | | 9/2002 | Sharma et al. |
| 2003/0008797 | A1 | | 1/2003 | Hage et al. |
| 2003/0099717 | A1 | | 5/2003 | Cabrera |
| 2003/0235623 | A1 | | 12/2003 | Van Oosterom |
| 2004/0067159 | A1 | | 4/2004 | Carnes et al. |
| 2004/0170742 | A1 | | 9/2004 | Ben Yehuda et al. |
| 2004/0234569 | A1 | | 11/2004 | Nakada et al. |
| 2005/0013836 | A1 | | 1/2005 | Raad |
| 2005/0194357 | A1 | | 9/2005 | Liu et al. |
| 2005/0256017 | A1 | | 11/2005 | Dykstra |
| 2005/0256200 | A1 | | 11/2005 | Burkhart et al. |
| 2006/0035808 | A1 | | 2/2006 | Ahmed et al. |
| 2006/0122082 | A1 | | 6/2006 | Paul |
| 2006/0182813 | A1 | | 8/2006 | Holladay |
| 2006/0198798 | A1 | | 9/2006 | Tichy et al. |
| 2006/0240381 | A1 | | 10/2006 | Rizoiu et al. |
| 2006/0263239 | A1 | | 11/2006 | Tichy et al. |
| 2006/0289316 | A1 | | 12/2006 | Henry |
| 2007/0003603 | A1 | | 1/2007 | Karandikar et al. |
| 2007/0048175 | A1 | * | 3/2007 | Tichy et al. ..... 422/28 |
| 2007/0073081 | A1 | | 3/2007 | Fisher |
| 2007/0167340 | A1 | | 7/2007 | Barthel et al. |
| 2007/0215496 | A1 | | 9/2007 | Scarborough |
| 2007/0254044 | A1 | | 11/2007 | Karandikar et al. |
| 2009/0004289 | A1 | | 1/2009 | Tichy |
| 2009/0053323 | A1 | | 2/2009 | Tichy |
| 2009/0232860 | A1 | | 9/2009 | Larson |
| 2010/0074967 | A1 | | 3/2010 | Tichy |

FOREIGN PATENT DOCUMENTS

| | | |
|---|---|---|
| WO | WO 2005/000324 | 1/2005 |
| WO | 2006/079109 | 7/2006 |
| WO | WO 2006/079109 | 7/2006 |
| WO | WO 2006/093792 | 9/2006 |

OTHER PUBLICATIONS

SeaquistPerfect Dispensing; Fusion; http://www.seaquistperfect.com/PAGES/C__Dispensing/fusion.html ; as accessed on Mar. 3, 2008; 2 pages.

N. Surdeau et al. Sensitivity of bacterial biofilms and planktonic cells to a new antimicrobial agent, Oxsil 320N, Journal of Hospital Infection, 2006 62 487-493, www.sciencedirect.com.

Brady, Michael J. et al. "Persistent silver disinfectant for the environmental control of pathogenic bacteria," Am. J. Infect. Control, Aug. 2004, pp. 208-214, vol. 31 (4).

Brentano, Loreno et al., "Antibacterial efficacy of a colloidal silver complex," Surg. Forum, 1966, pp. 76-78, vol. 12.

Phillips, Charles R., et al., "Chemical Disinfectant," Annual Review of Microbiology, Oct. 1958, pp. 525-550, vol. 12.

Monarca, S. et al, "Decontamination of dental unit waterlines using disinfectants and filters," Abstract Only, Minerva Stomatol., Oct. 2002, vol. 10.

Yin, Huiyong, "Analysis of Diacyl Peroxides by Ag+Coordination Ionspray Tandem Mass Spectrometry: Free Radical Pathways of Complex Decomposition," J. Am. Soc. Mass Spectrum, Apr. 2001, pp. 449-455, vol. 12 (4).

Schuster, A. et al., "Persistent silver disinfectant for the enviromental myth and reality," Am. J. Infect. Control, Jun. 2003, pp. 309-311, vol. 32.

Virosil F&B, "Swift Virucidal with Swiss Precision," http://web.archive.org/web/20060217191603/http://sanosilbiotech.com/start__food.html, Feb. 17, 2006, 5 pages.

(56) References Cited

OTHER PUBLICATIONS

The interaction of silver ions and hydrogen peroxide in the inactivation of *E coli*; a preliminary evaluation of a new long lasitng residual drinking water disinfectant; Water Science and Technology vol. 31 No. 5-6 pp. 123-129 (1995).

Psi. Brochure. Venting Products. Circumvent & AirFoil. 4 pages.

Psi. Container Venting. http://www.psix.com/containerventing.htm. As accessed on Nov. 12, 2008. 1 page.

Psi. Container Venting. Problems We Solve. http://www.psix.com/cv_problems.htm. As accessed on Nov. 12, 2008. 2 pages.

Psi. Container Venting. Circumvent & AirFoil. http://www.psix.com/cv_products_circumvent.htm. As accessed on Nov. 12, 2008. 2 pages.

Psi. Container Venting. Linerless Application. http://www.psix.com/cv_products_linerless.htm. As accessed on Nov. 12, 2008. 1 page.

Pending U.S. Appl. No. 12/617,355, filed Nov. 12, 2009. Brian G. Larson.

Pending U.S. Appl. No. 12/617,521, filed Nov. 12, 2009. Brian G. Larson.

U.S. Appl. No. 12/403,642, filed Mar. 13, 2009; Brain G. Larson; office action issued Dec. 27, 2011.

Klenk et al; Peroxy Compounds, Organic; Ullmann's Encyclopedia of Industrial Chemistry; published online Jun. 15, 2000.

* cited by examiner

MULTI-CHAMBER CONTAINER SYSTEM FOR STORING AND MIXING LIQUIDS

This application claims the benefit of U.S. Provisional Patent Application No. 61/113,974, filed Nov. 12, 2008.

BACKGROUND

Many compositions are made of two or more components which are not mixed together until shortly before use of the compositions. For example, some disinfectant or cleaning compositions include two or more components. In many such cases, at least one of the components can have a reduced chemical stability when diluted or some other reduced shelf-life once combined into the final compositions. Therefore, it can be beneficial to package some compositions as separate components in multi-component systems which can be combined shortly before use. Typically, individual components in a multi-component system are packaged at higher concentration, and then are combined in a final combined composition. Unfortunately, for some compositions, increased concentrations of certain components can render the component hazardous, thereby requiring increased costs associated with packaging, shipping, and handling of the hazardous component.

DETAILED DESCRIPTION

Figure 1:
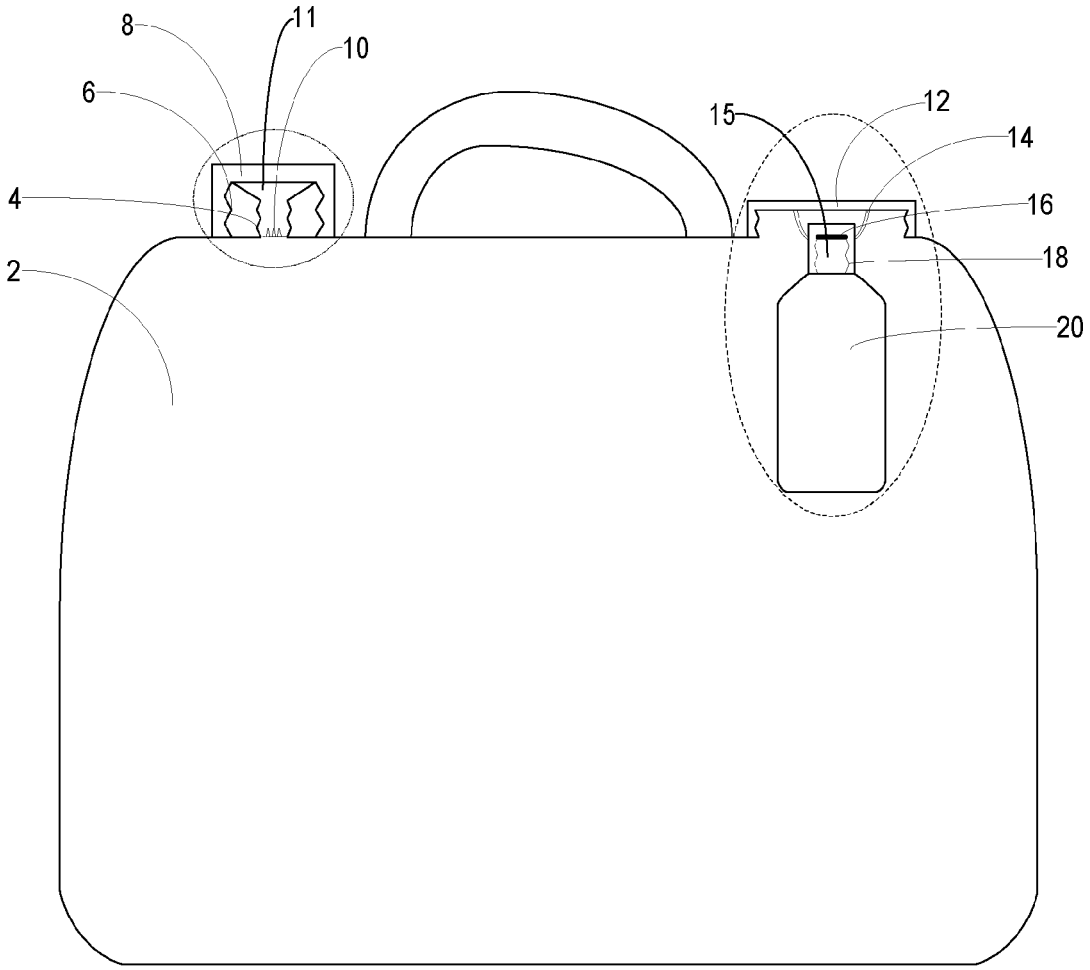
FIG. 1 is a cross-sectional schematic view of a system in accordance with the present disclosure, the system being shown in a first configuration.

Reference will now be made to the exemplary embodiments, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention. It is also to be understood that the terminology used herein is used for the purpose of describing particular embodiments only. The terms are not intended to be limiting unless specified as such.

It must be noted that, as used in this specification and the appended claims, the singular forms "a," "an," and "the" include plural referents unless the content clearly dictates otherwise.

The term "multi-part" when referring to the systems of the present invention is not limited to systems having only two parts. For example, the system can have two or more liquids present in a single system.

The term "colloidal transition metals" refers to colloidal particles of elemental transitional metals or the alloys of such elemental transition metals. Colloidal transition metals are distinct from salts and oxides of transition metals. Accordingly, compounds such as silver oxide, silver nitrate, silver chloride, silver bromide, silver iodide, and the like are not colloidal transition metals under the present invention.

In describing embodiments of the present invention, reference will be made to "first" or "second" as they relate to chambers, compartments, or liquid compositions, etc. It is noted that these are merely relative terms, and a chamber or composition described or shown as a "first" chamber or composition could just as easily be referred to a "second" chamber or composition, and such description is implicitly included herein.

Discussion of liquids or fluids herein does not require that each component be completely liquid. For example, a liquid or fluid can be a solution or even a suspension. Thus, a colloidal metal-containing liquid or fluid is considered to be a liquid or fluid as defined herein.

Concentrations, dimensions, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a weight ratio range of about 1 wt % to about 20 wt % should be interpreted to include not only the explicitly recited limits of about 1 wt % and about 20 wt %, but also to include individual weights such as 2 wt %, 11 wt %, 14 wt %, and sub-ranges such as 10 wt % to 20 wt %, 5 wt % to 15 wt %, etc.

In accordance with these definitions and embodiments of the present disclosure, a discussion of the various systems and methods is provided including details associated therewith. This being said, it should be noted that various embodiments will be discussed as they relate to the systems and methods. Regardless of the context of the specific details as they are discussed for any one of these embodiments, it is understood that such discussion relates to other all other embodiments as well.

Accordingly, the present disclosure is drawn to a multi-chamber container system for storing and mixing liquids. The system can include a first chamber configured to hold a first liquid and which has at least one opening and a second chamber and a second chamber configured to hold a second liquid and having at least one opening. The at least one opening on the second chamber is capable of being operably connected to the at least one opening of the first chamber, and the second chamber can be smaller relative to the first chamber. The system can have two configurations, a first configuration and a second configuration. In the first configuration, the second chamber can be removably disposed within the first chamber. In the second configuration, the second chamber can at least partially be external to the first chamber. The at least one opening of the second chamber in this configuration can be operably connected with the at least one opening of the first chamber such that the second liquid is allowed to contact the first liquid, e.g., pour from chamber to chamber in one embodiment.

In another embodiment, the disclosure provides a method of storing, transporting, and/or mixing multiple liquids to form a mixed liquid composition for use. The method includes providing a system having a first chamber configured to contain a first liquid and having at least one opening, and a second chamber configured to contain a second liquid and having at least one opening which is capable of being operably connected to the at least one opening of the first chamber. The second chamber can be smaller relative to the first chamber such that the second chamber can be enclosed within the first chamber. The system is provided in a first configuration in which the second chamber is disposed within the first chamber. The method further includes the step of removing the second chamber from within the first chamber and placing the system in a second configuration by operably connecting the at least one opening of the second chamber to the at least one opening of the first chamber such that the second chamber is external to the first chamber and the first liquid and the second liquid can mix together. Lastly, the first liquid and second liquid are allowed to mix in the first chamber to form a mixed liquid.

Figure 3A:
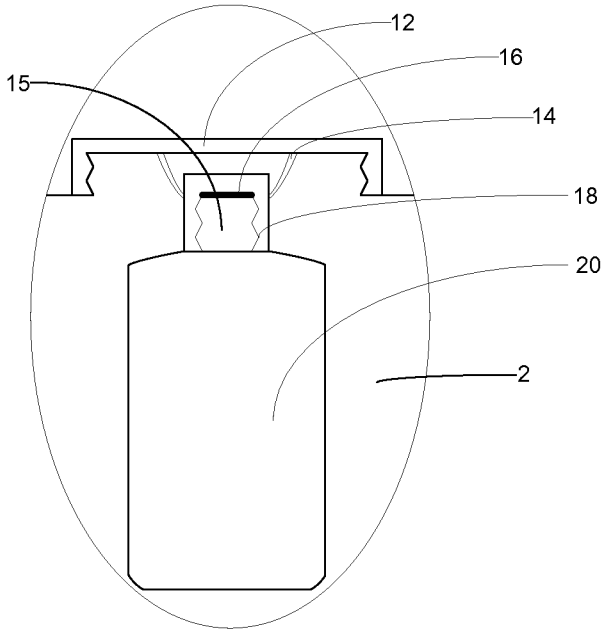
FIG. 3A is an enlarged view of a portion of FIG. 1 in which the system is in the first configuration, having the second chamber disposed within the first chamber.
Figure 3B:
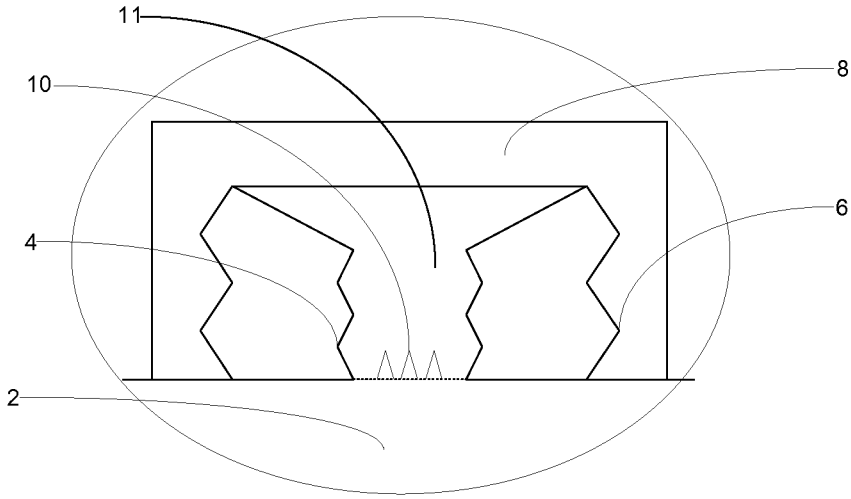
FIG. 3B is an enlarged view of a portion of FIG. 1 showing the at least one opening of the first chamber having external and internal threading.

FIG. 1 shows a cross-sectional schematic view of one embodiment of a system of the present disclosure. The system is shown in the first configuration with the second chamber 20 removably disposed within the first chamber 2. In the embodiment shown in FIG. 1, the first chamber has an opening 11, which can be sealed by any mechanism known in the art, including but not limited to screwed or clamped on caps and lids, corks, stoppers, ruptureable seals or membranes, or the like. As shown in FIG. 1, in this particular embodiment, the opening is sealed with a threaded lid 8. FIG. 3B shows an enlarged region of the opening and the threaded lid of the first chamber of FIG. 1. As shown in both FIGS. 1 and 3B, the opening is externally threaded 6 to receive the internally threaded lid. When threaded together, the lid can act to seal or close the opening. The opening also has internal threading 4 and an opening mechanism 10 which is capable of ripping or opening any seal on the second chamber upon engagement therewith.

As discussed above, the second chamber 20 of FIG. 1 is shown in the first configuration being removably disposed within the first chamber 2. FIG. 3A shows an enlarged region of the second chamber as it relates to the first chamber in the first configuration of the system. The second chamber has an opening 15 which is oriented substantially upright and which is sealed with a cap 16. The cap prevents the escape of the second liquid which can be present in the second chamber. The cap can be any type of seal or sealing component known in the art including, but not limited to, lids, corks, stoppers, magnetic heat seals, combinations thereof, and the like. In one embodiment, the cap can be a vented cap that acts like a one-way valve allowing for the escape of gas from the second chamber without allowing for the escape of the liquid in the second chamber. Vented caps are known and available in the art. Examples of commercially available vented caps can include those made and sold by Performance Systematic Inc such as the Circumvent® and Airfoil® vented liner systems. Other vented liners systems can also be used. In this embodiment, the second chamber is held in place with respect to the first chamber by a clip mechanism 14. However, it is noted that the second chamber can alternatively be held in place by other mechanisms, such as a housing within the first chamber. In the embodiment shown in FIGS. 1 and 3A, the clip mechanism 14 is shown attached to a lid which is screwed onto the first chamber and thereby aids in forming the first chamber. In other embodiments, the clip mechanism could be incorporated directly into the external wall of the first chamber.

When a clip mechanism 14 is not used, the second chamber 20 may be removably disposed and retained in the first configuration within the first chamber 2 by other mechanical means. Generally speaking, any retaining mechanism or means known in the art can be used so long as the retaining mechanism or means safely retains the second chamber within the first chamber and, should there be a leak of the second liquid (or related gas) from the second chamber, the retaining mechanism allows for the leaked liquid or gas to come into contact with and/or dissipate into the first liquid present in the first chamber. In one embodiment, the retaining mechanism can include a mesh, porous or permeable retaining compartment that is integrated or operably connected to the wall of the first chamber.

Figure 2:
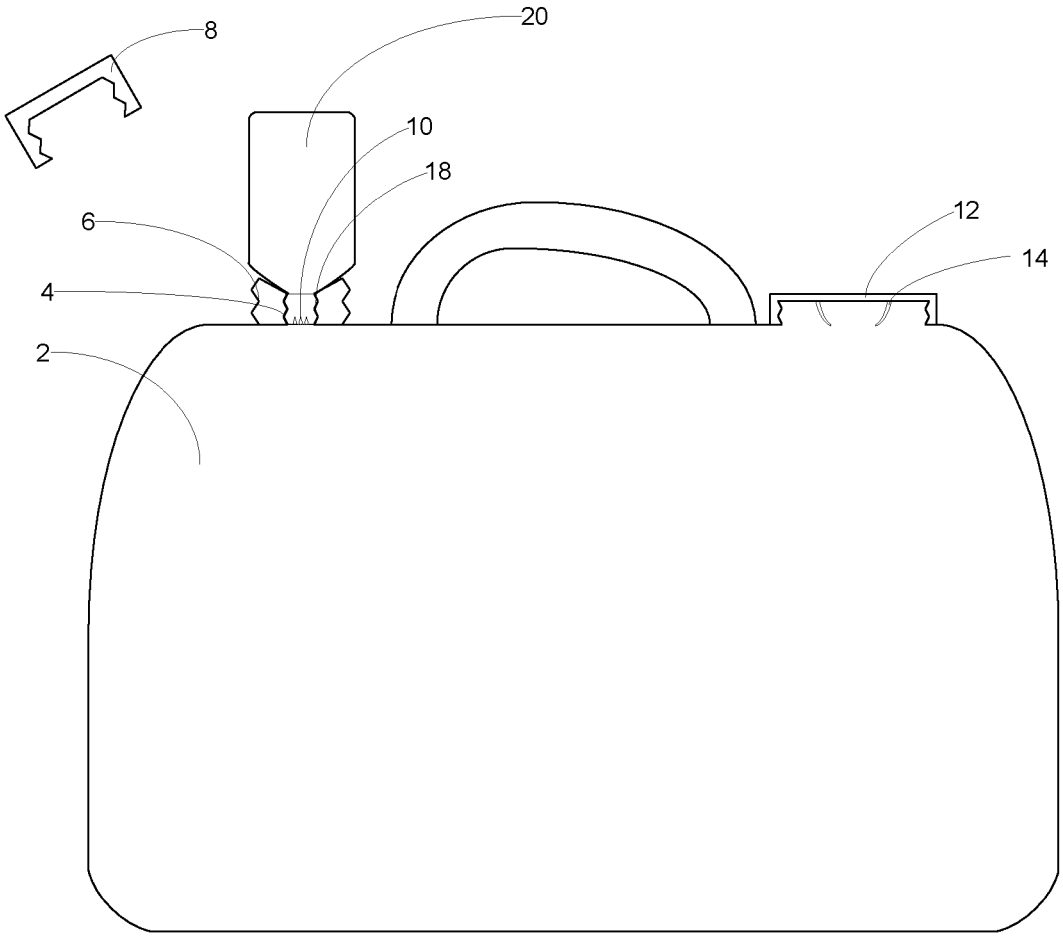
FIG. 2 is a cross-sectional schematic view of a portion of the system shown in FIG. 1, except that the system is shown in a second configuration.

Prior to dispensing or mixing the first liquid and the second liquid in the disclosed systems, the second chamber 20 is removed from within the first chamber 2 and operably connected to the first chamber of the system, thereby placing the system in the second configuration. FIG. 2 shows the same system as in FIG. 1 except that it is in the second configuration, the second chamber being external to the first chamber and operably connected to the first chamber. When in the second configuration, the opening 15 of the second chamber can be operably connected to the opening 11 of the first chamber. In one embodiment, such as shown in FIG. 1 and the enlargement in FIG. 3B, the opening of the first chamber can be internally threaded 4. The internal threading can correspond to or mate with external threading 18 on the opening of the second chamber, thereby allowing for the two chambers to become operably connected by screwing the opening of the second chamber into the opening of the first chamber. Other connection mechanisms can also be used to operably connect the second chamber and the first chamber. For example, in one embodiment, the opening of the second chamber can have a plurality of external tabs which, when paired with corresponding slots in the opening in the first chamber, form a locking mechanism, thereby operably connecting the second chamber and the first chamber. Other methods of operably connecting the two chambers can also be used.

When the second chamber 20 is operably connected to the first chamber 2 via the openings of the two chambers, the connection allows for contacting of the first liquid and the second liquid. In one embodiment, the opening 15 of the second chamber can be sealed with a cap 16 that is rupturable. The cap over the opening in the second chamber can be ruptured as the second chamber is operably connected, e.g. screwed, into the opening of the first chamber and the cap encounters an opening mechanism 10, which can be present in the opening 11 of the first chamber. The opening mechanism can be a single or plurality of tooth-like protrusions or it can take any other shape or size so long as they are effective in ripping, tearing or otherwise opening the seal over the opening of the second chamber as the second chamber is operably connected into the opening of the first chamber. The opening mechanism can be particularly advantageous when the liquid present in the second chamber is a dangerous or hazardous liquid. For example, if the liquid in the second container is a concentrated acid, the user does not need to be exposed to the concentrated acid in order to facilitate the mixing of the acid with the liquid in the first chamber. When the second chamber is screwed into the first chamber, such as shown in FIG. 2, the fluid within the second chamber is only exposed to an external environment when the opening mechanism opens the seal on the second chamber inside the threaded opening of the first chamber.

Figure 4:
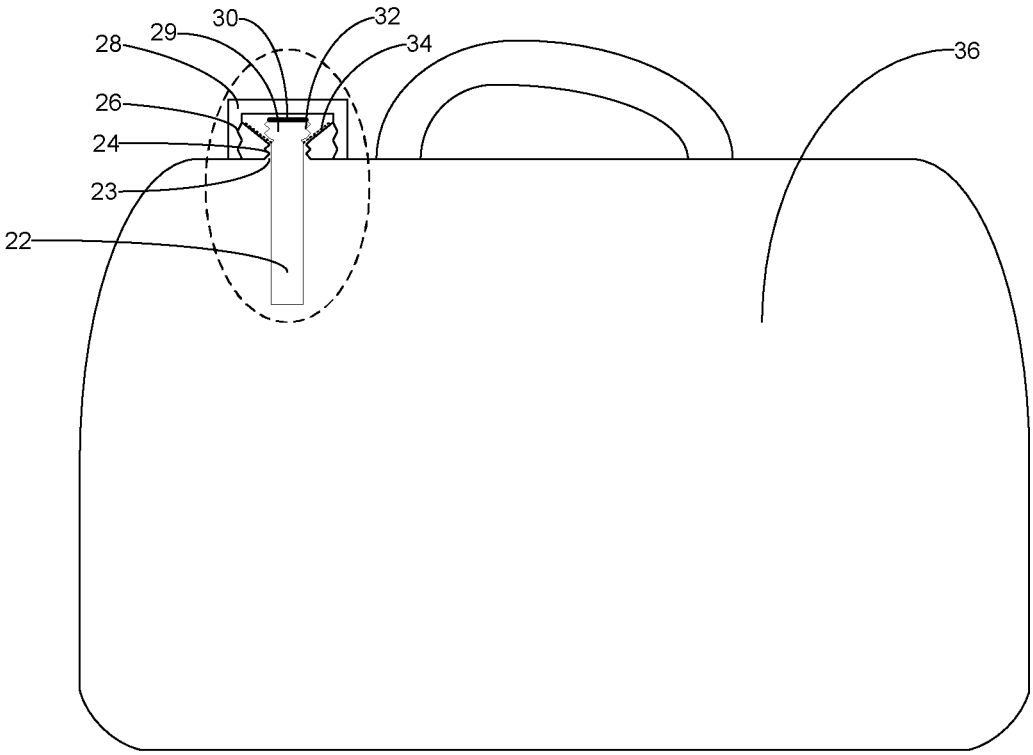
FIG. 4 is a cross-sectional schematic view of a second embodiment of a system that is in accordance with the present disclosure.
Figure 5:
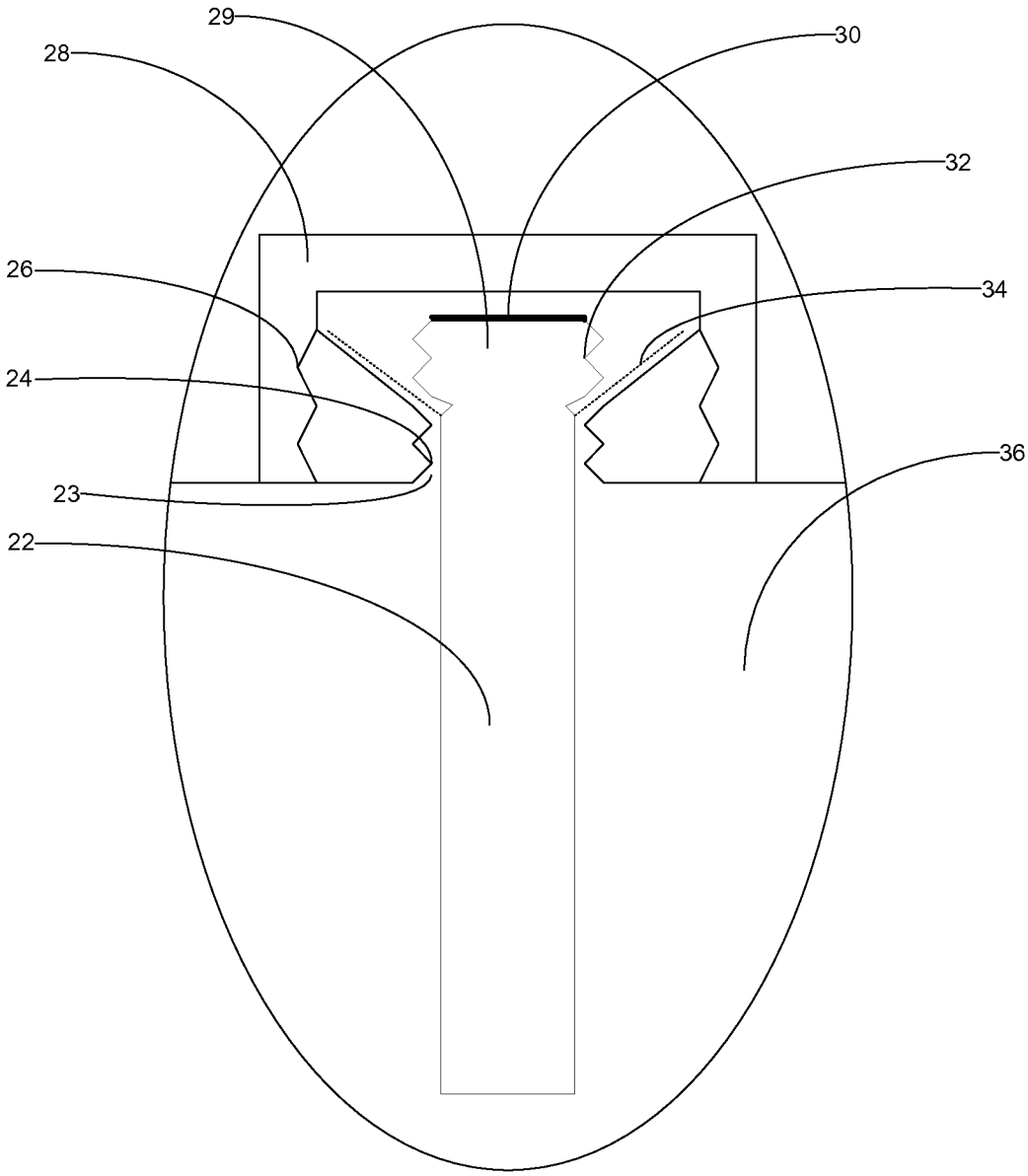
FIG. 5 is an enlarged view of a portion of FIG. 4 showing the system in the first configuration with the second chamber disposed within the first chamber

FIG. 4 shows another embodiment of the system of the present invention. Unlike the embodiment shown in FIG. 1, the system shown in FIG. 4 shows a second chamber 22 of a different configuration being removeably disposed within the first chamber 36 through the same opening 23 in the first chamber to which the second chamber can be operably connected. As shown in FIG. 4, the system is in the first configuration, i.e. the second chamber enclosed within the first chamber. The second chamber can be retained in place within the first chamber by a retaining collar 34 which prevents the second chamber from falling to the bottom of the first chamber. FIG. 5 shows an enlarged portion of FIG. 4, specifically the second chamber being removeably disposed within the first chamber.

As with the above described embodiments, the system shown in FIG. 4 can have a second configuration (not shown) in which the second chamber is removed from within the first chamber and then operably connected to the opening 23 of the first chamber by a connection mechanism such as those discussed above. The system shown in FIG. 4 and enlarged in FIG. 5 shows the opening 29 on the second chamber 22 having external threading 32 and being sealed with a seal so as to prevent the escape of the fluid held therein. The opening of the first chamber has internal threading 24 which corresponds or mates with the external threading of the second chamber. In order to place the system of FIG. 4 in the second configuration, the user could remove the cap 28 from the opening of the first chamber, remove the second chamber from the first chamber, remove the retaining collar 34 (either by snapping it off or by sliding it off along the bottom of the second chamber), and inverting the second chamber with respect to the first chamber. Once inverted, the second chamber could be operably connected by a connecting mechanism to the first chamber by the openings in each chamber. Although not shown, the system of FIG. 4 could also include the an opening mechanism, such as the tooth-like protrusions shown in FIG. 1, which act to cut or tear open the cap 30 on the second chamber when it is operable connected to the first chamber.

The systems and methods of the present invention can be used with any multi-part liquid composition or system. The systems are particularly advantageous for multi-part compositions which have limited or shortened stabilities, shelf-lives, or functional time periods once combined. As such, in one aspect of the present invention, the step of operably connecting the second chamber and the first chamber can be performed shortly before dispensing the mixed liquids from the first chamber. An example of a multi-part system which can be used herein is a multi-part disinfectant composition which, in its final form, can include a composition including an amount of a transition metal, e.g. a colloidal or ionic transition metal, and a peroxygen, e.g., peracids and/or peroxides. The composition could also include other ingredients such as alcohols or other organic co-solvents, or even dispersed particles, such as colloidal metals.

The above described disinfectant system can be effectively used to provide disinfection of a wide variety of surfaces. However, the peracid component of the composition can have a limited shelf-life, particularly at concentrations that are relatively low. As such, the system of the present invention provides an effective means for safely packaging, handling, shipping, storing, and ultimately mixing such a composition in a two-component format until shortly before use. For example, the above described disinfectant composition could be packaged into a system of the present invention such that an aqueous vehicle, including a transition metal (ionic or colloidal) component and/or alcohol or possibly other organic components are placed in the larger first chamber of the system, while a concentrated, and thereby more stable, peracid liquid is placed in the smaller second chamber. By maintaining a somewhat elevated concentration of peracid in the liquid of the second chamber, the peracid has an enhanced stability, and therefore a longer shelf-life. Further, the system of the present invention provides for a safe means for packaging such individually separated compositions. Typically, solutions having elevated peracid concentrations are viewed as being hazardous, and therefore, difficult to ship and sell to the public. The system of the present disclosure would allow for the peracid liquid of the system to be packaged within the second chamber and enclosed within the first chamber for safety. Such a configuration makes the system more safely shipped and stored because any leak from the second chamber would be retained within the first chamber and safely dispersed and neutralized into the first liquid present in the first chamber.

Specific details of one specific type of composition which can be used in the systems of the present inventions are described in U.S. patent application Ser. No. 11/514,721, which is incorporated herein by reference.

What is claimed is:

1. A multi-chamber container system for storing and mixing liquids, comprising:

a first chamber containing a first liquid composition and having at least one opening, and a second chamber containing a second liquid composition and having at least one opening which is capable of being operably connected to the at least one opening of the first chamber, said second chamber being smaller relative to the first chamber, wherein said system has a first configuration in which the second chamber is removably disposed within the first chamber and a second configuration in which the second chamber is removed from and external to the first chamber and the at least one opening of the second chamber is directly and operably connected with the at least one opening of the first chamber such that the second liquid is allowed to contact the first liquid.

2. A system as in claim 1, wherein the at least one opening of the first chamber includes external threading onto which a threaded cap may be attached.

3. A system as in claim 1, wherein the at least one opening of the second chamber and the at least one opening of the first chamber each include a connecting mechanism for operably connecting the second chamber to the first chamber.

4. A system as in claim 3, wherein the connecting mechanism of the at least one opening of the second chamber includes external threading.

5. A system as in claim 4, wherein the connecting mechanism of the at least one opening of the first chamber includes internal threading and the internal threading of the at least one opening of the first chamber mates with the external threading of the at least one opening of the second chamber when the system is in the second configuration.

6. A system as in claim 5, wherein the second chamber is operably connected to the first chamber by screwing the at least one opening of the second chamber into the internal threads of the at least one opening of the first chamber.

7. A system as in claim 3, wherein the at least one opening of the second chamber is sealed with a cap to retain the second liquid composition in the second container.

8. A system as in claim 7, wherein the cap which seals the at least one opening of the second chamber is a vented cap.

9. A system as in claim 7, wherein the cap which seals the at least one opening of the second chamber allows for release of head gas from the second chamber into the first chamber when the system is in the first configuration.

10. A system as in claim 7, wherein the at least one opening of the first chamber includes an opening mechanism which opens the cap on the at least one opening of the second chamber when the second chamber is screwed into the at least one opening of the first chamber.

11. A system as in claim 10, wherein the opening mechanism is a plurality of tooth-like protrusions which cut the cap which seals the at least one opening of the second chamber.

12. A system as in claim 1, wherein the second chamber is disposed within the first chamber such that the at least one opening of the second chamber is uprightly oriented with respect to the first chamber.

13. A system as in claim 1, wherein when the system is in the first configuration the second chamber is removably disposed by a retaining mechanism within the first chamber.

14. A system as in claim 13, wherein the retaining mechanism is a clip configured to retain the second chamber.

15. A system as in claim 1, wherein the at least one opening of the first chamber includes a first and a second opening and the second chamber is disposed within the second opening when the system is in the first configuration and is operably attached to the first opening in the second configuration.

16. A system as in claim 1, wherein the first liquid composition includes an alcohol.

17. A system as in claim 1, wherein the first liquid composition includes a transition metal.

18. A system as in claim 17, wherein the transition metal is colloidal silver.

19. A system as in claim 1, wherein the second liquid composition includes a peracid.

20. A multi-chamber container system for storing and mixing liquids, comprising:

a first chamber configured to contain a first liquid composition and having at least one opening, and a second chamber configured to contain a second liquid composition and having at least one opening which is capable of being operably connected to the at least one opening of the first chamber, said second chamber being smaller relative to the first chamber, wherein said system has a first configuration in which the second chamber is removably disposed within the first chamber and a second configuration in which the second chamber is external to the first chamber and the at least one opening of the second chamber is operably connected with the at least one opening of the first chamber such that the second liquid is allowed to contact the first liquid wherein the at least one opening of the second chamber and the at least one opening of the first chamber each include a connecting mechanism for operably connecting the second chamber to the first chamber, wherein the at least one opening of the second chamber is sealed with a cap to retain the second liquid composition in the second container, wherein the at least one opening of the first chamber includes an opening mechanism that which opens the cap on the at least one opening of the second chamber when the second chamber is screwed into the at least one opening of the first chamber, and wherein the opening mechanism is a plurality of tooth-like protrusions which cut the cap which seals the at least one opening of the second chamber.

* * * * *